US010132552B2

(12) United States Patent
Yang

(10) Patent No.: US 10,132,552 B2
(45) Date of Patent: Nov. 20, 2018

(54) REFRIGERATOR HAVING REFRIGERATION SYSTEM AND ICE MAKER WITHIN DOOR AND DRAIN DUCT FROM ICE MAKER TO DISPENSER EXCESS WATER TRAY

(71) Applicant: Dongbu Daewoo Electronics Corporation, Seoul (KR)

(72) Inventor: Sung Jin Yang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 360 days.

(21) Appl. No.: 14/841,107

(22) Filed: Aug. 31, 2015

(65) Prior Publication Data

US 2016/0370096 A1 Dec. 22, 2016

(30) Foreign Application Priority Data

Jun. 17, 2015 (KR) ..... 10-2015-0086081

(51) Int. Cl.

| | |
|---|---|
| ***F25D 21/00*** | (2006.01) |
| ***F25D 21/08*** | (2006.01) |
| ***F25C 5/20*** | (2018.01) |
| ***F25C 5/00*** | (2018.01) |
| ***F25D 21/14*** | (2006.01) |
| ***F25D 23/12*** | (2006.01) |

(Continued)

(52) U.S. Cl.

CPC ..... *F25D 21/08* (2013.01); *F25C 1/00* (2013.01); *F25C 5/005* (2013.01); *F25C 5/22* (2018.01); *F25D 21/14* (2013.01); *F25D 23/126* (2013.01); *F25D 23/02* (2013.01); *F25D 2400/14* (2013.01)

(58) Field of Classification Search

CPC ... F25C 2400/10; F25C 2500/06; F25D 19/04

See application file for complete search history.

(56) References Cited

U.S. PATENT DOCUMENTS 3,905,203 A * 9/1975 Jacob ..... F24F 3/1405 165/110

2010/0326112 A1 12/2010 Prabhakar et al.

(Continued)

FOREIGN PATENT DOCUMENTS

EP 2320175 A1 5/2011

EP 2610564 A2 7/2013

(Continued)

OTHER PUBLICATIONS

Extended European Search Report dated Nov. 18, 2016 issued in corresponding European Patent Application No. 15186866.8.

*Primary Examiner* — David Teitelbaum

(57) ABSTRACT

Embodiments of the present invention provide a refrigerator comprising an ice machine, the refrigerator comprising: a main body, a door, a dispenser disposed on a front surface of the door, a compressor, a condenser and an expansion valve on the door, an ice tray disposed in the ice-making compartment, a refrigerant pipe configured to connect the compressor, the condenser, and the expansion valve, a heater disposed at a peripheral portion of the ice tray, a drain duct disposed under the ice tray, and a defrost water discharge pipe configured to couple the drain duct and the excess water tray.

13 Claims, 6 Drawing Sheets

(51) Int. Cl.
*F25C 1/00* (2006.01)
*F25D 23/02* (2006.01)

(56) References Cited

U.S. PATENT DOCUMENTS

| | | | | |
|---|---|---|---|---|
| 2011/0162404 | A1* | 7/2011 | Shin | F25D 23/006 62/340 |
| 2013/0167563 | A1 | 7/2013 | Lee et al. | |
| 2014/0216096 | A1* | 8/2014 | Leclear | F25B 1/005 62/340 |

FOREIGN PATENT DOCUMENTS

| | | | |
|---|---|---|---|
| KR | 20-2000-0010981 | U | 6/2000 |
| KR | 10-2012-0003233 | A | 1/2012 |
| KR | 10-1283190 | | 7/2013 |
| KR | 10-1339519 | | 12/2013 |
| WO | WO 2009/17282 | | 2/2009 |
| WO | WO 2009/17283 | | 2/2009 |

* cited by examiner

REFRIGERATOR HAVING REFRIGERATION SYSTEM AND ICE MAKER WITHIN DOOR AND DRAIN DUCT FROM ICE MAKER TO DISPENSER EXCESS WATER TRAY

CROSS-REFERENCE TO RELATED APPLICATIONS

This application is based on and claims priority from Korean Patent Application No. 10-2015-0086081, filed on Jun. 17, 2015, the disclosure of which is incorporated herein in its entirety by reference.

FIELD OF THE INVENTION

Embodiments of the present invention generally relate to a refrigerator including an ice machine. Embodiments of the present invention further relate to a method of collecting defrost water of the refrigerator.

BACKGROUND OF THE INVENTION

A refrigerator is a device for storing food in a low temperature state and may be configured to preserve food in a frozen state or in a cool state according to the type of the food which a user wants to store.

An inside of the refrigerator is continuously supplied with cold air. The cold air is continuously generated by a heat exchange process with refrigerant, based on a cooling cycle, which goes through a process of compression-condensation-expansion-evaporation.The cold air is supplied to the inside of the refrigerator by convection to maintain the food in the refrigerator at a desired temperature.

Generally, a main body of the refrigerator has a rectangular parallelepiped shape of which the front surface is open and the inside of the main body may be provided with a refrigerating compartment and a freezing compartment. Further, the front surface of the main body may be provided with a refrigerating compartment door and a freezing compartment door for selective access of a portion of the refrigerator. A storage compartment in the refrigerator may be provided with multiple drawers, shelves, receiving boxes, etc., in which various food may be stored in an optimal condition.

Traditionally, a top mount type refrigerator has a freezing compartment positioned at an upper portion and has a refrigerating compartment positioned at a lower portion. Recently, however, for user convenience, a bottom freezer type refrigerator in which the freezing compartment is positioned at a lower portion has been released. In the case of the bottom freezer type refrigerator, a frequently used refrigerating compartment is positioned at an upper portion and a relatively less used freezing compartment is positioned at a lower position. Thus a user may conveniently use the refrigerating compartment. However, since the freezing compartment is positioned at the lower portion, the bottom freezer type refrigerator has a problem in that a user needs to bend over to open the freezing compartment door to remove ice.

To solve the above problem, recently, a refrigerator has been released in which a dispenser for removing ice is installed in the refrigerating compartment door positioned at the upper portion of the bottom freeze type refrigerator. In this case, the refrigerating compartment door or the inside of the refrigerating compartment may be provided with an ice machine.

The ice machine may include an ice-making assembly which includes an ice tray for generating ice, an ice bucket for storing the generated ice, and a transfer assembly for transferring the ice stored in the ice bucket to a dispenser.

In addition, a duct for ice making is provided so that the freezing compartment and the ice machine are coupled together, wherein the duct for ice making is disposed on a left-side or right-side wall surface portion of the refrigerating compartment to couple with a freezing compartment of the ice-making compartment when a door is closed.

Accordingly, the duct for ice making and the ice-making compartment are separated from each other when the door is open, and the duct for ice making and the ice-making compartment are configured to couple with each other when the door is closed. Thus, when the door is closed, cold air in the freezing compartment is supplied through the duct for ice making to the ice-making compartment as cold air for generating ice.

However, the conventional refrigerator design has the following problems.

First, since the duct for ice making must be disposed on a left-side or right-side wall surface portion of the refrigerating compartment, a structure for insulating the duct must be added thereto. Further, the internal capacity of the refrigerator is reduced, and the pipe structure in the refrigerator is complex.

Second, cold air can be transferred from the freezing compartment to an ice-making compartment only when the door is closed, and the cold air passing through the ice making duct is discharged to the outside when the door is open, and thereby reducing the energy efficiency is.

Third, since ice making is achieved with an indirect cooling scheme in which ice is generated by cold air supplied through the duct, direct cooling is not achieved, thereby increasing the time required for ice-making.

Fourth, since the ice machine is maintained at a low temperature state, the ice machine is typically covered with frost. If such frost is not effectively removed, the ice machine frequently malfunctions or fails.

SUMMARY OF THE INVENTION

In view of the above, embodiments of the present invention provide a refrigerator including an ice machine which does not require a duct for transferring cold air for ice making where the ice machine is disposed on a refrigerating compartment door, thereby having a simple structure with a maximized internal capacity, and a defrost water collecting method.

Further, embodiments of the present invention provide a refrigerator including an ice machine which enables the cooling of an ice-making compartment regardless of whether a door is opened or closed, thereby increasing energy efficiency, and a defrost water collecting method.

Further, embodiments of the present invention provide a refrigerator including an ice machine which enables ice making in a direct cooling scheme in an ice-making compartment disposed on a door, thereby having a high ice-making speed, and a defrost water collecting method.

Further, embodiments of the present invention provide a refrigerator including an ice machine which can effectively remove frost as the frost occurs on the ice machine, and a defrost water collecting method of the refrigerator.

In accordance with an embodiment of the present invention, there is provided a refrigerator including an ice machine, the refrigerator including: a main body configured to have a storage compartment for food; a door disposed on the main body, including an ice-making compartment, and configured to open and close the storage compartment; a dispenser disposed on a front surface of the door and configured for dispensing drinking water and including an excess water tray configured to collect excess dispensed water; a compressor, a condenser, and an expansion valve which are disposed on the door; an ice tray disposed in the ice-making compartment and configured to receive and accommodate water; a refrigerant pipe coupled the compressor, the condenser, and the expansion valve, and configured to cool the ice tray by conduction; a heater disposed at a peripheral portion of the ice tray; a drain duct disposed under the ice tray and configured to collect defrost water; and a defrost water discharge pipe coupled to the drain duct and the excess water tray, wherein defrost water collected in the drain duct is discharged to the excess water tray via the defrost water discharge pipe.

In accordance with another embodiment of the present invention, there is provided a defrost water collection method for a refrigerator, the method including: stopping ice-making of an ice machine disposed on a door of the refrigerator; driving a heater disposed at a peripheral portion of an ice tray included in the ice machine and configured to receive and hold or accommodate water, thereby removing frost formed on the ice tray; collecting defrost water, which is produced by heating of the frost, into a drain duct disposed under the ice tray; and discharging the defrost water collected in the drain duct to an excess water tray of a dispenser, disposed on a front surface of the door, via a defrost water discharge pipe coupled between the drain duct and the excess water tray.

BRIEF DESCRIPTION OF THE DRAWINGS

The objects and features of the present invention will become apparent from the following description of embodiments given in conjunction with the accompanying drawings, in which.

DETAILED DESCRIPTION OF THE EMBODIMENTS

Hereinafter, embodiments of the present invention will be described in detail with reference to the accompanying drawings which form a part hereof.

In the following description, a detailed description of known functions and configurations incorporated herein will be omitted to make the subject matter of the present invention clear.

Figure 1:
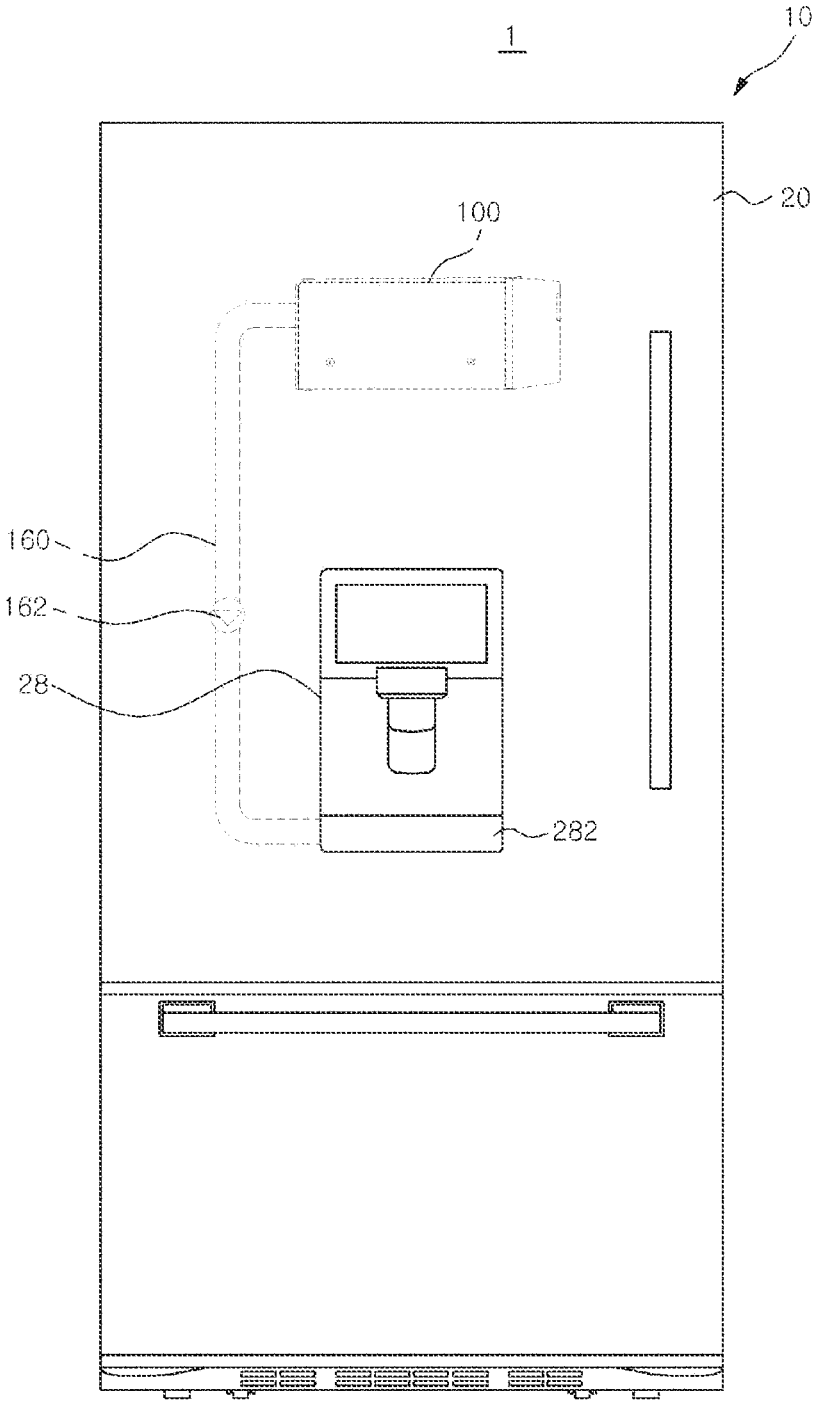
FIG. 1 is a perspective view illustrating a refrigerator with a closed door in accordance with an embodiment of the present invention.
Figure 2:
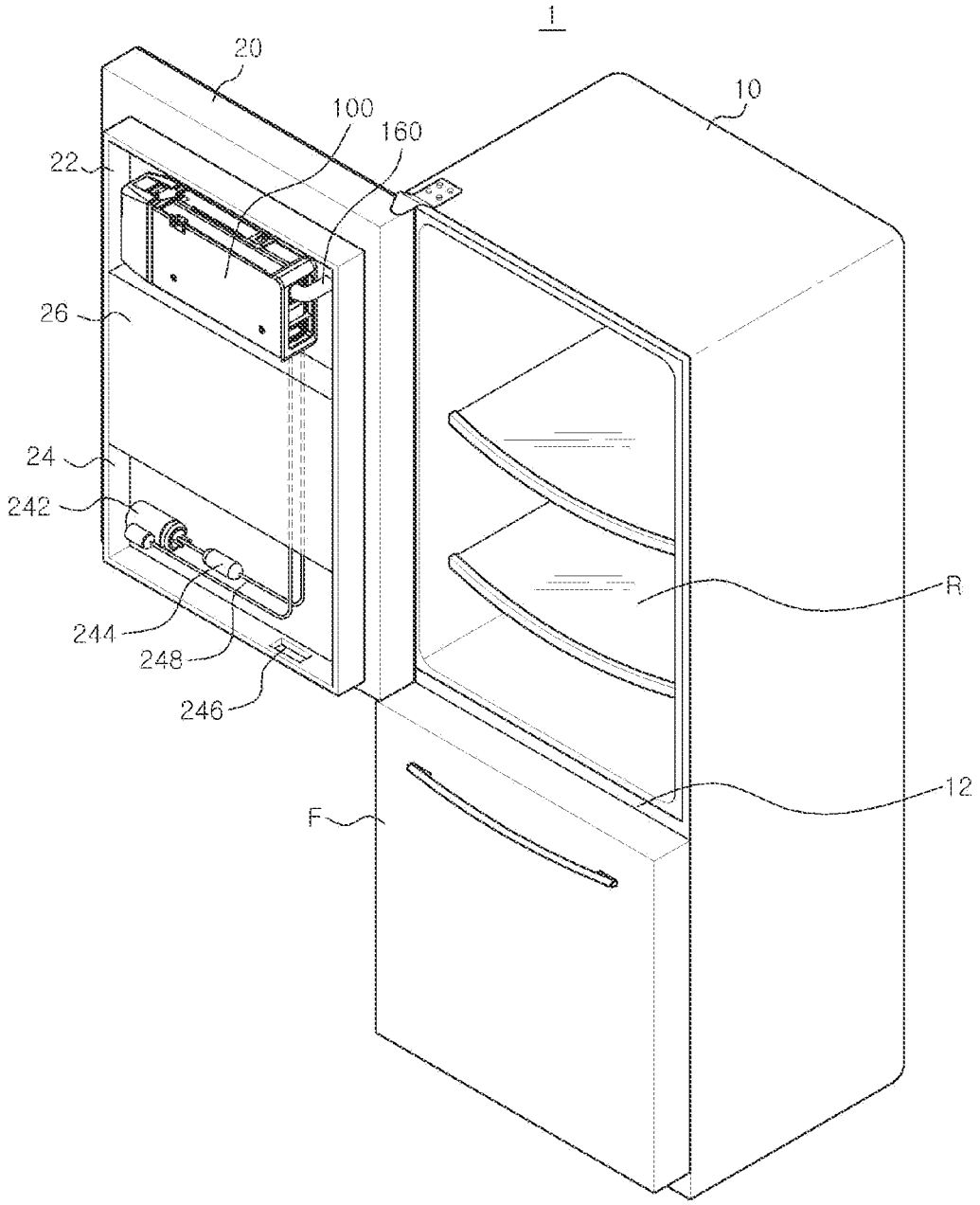
FIG. 2 is a perspective view illustrating when the door of the refrigerator, shown in FIG. 1, is open.

FIG. 1 is a perspective view illustrating a refrigerator with a closed door in accordance with an embodiment of the present invention, and FIG. 2 is a perspective view illustrating when the door of the refrigerator, shown in FIG. 1, is open.

Referring to FIGS. 1 and 2, in accordance with an embodiment of the present invention, a refrigerator 1 may include: a main body 10 configured to form an outer structure and/or appearance and configured to store food or the like; a barrier 12 configured to partition a food storage compartment formed in the main body 10 into an upper-side refrigerating compartment R and a lower-side freezing compartment F; and a door 20 provided on both of the side edges of a front surface of the main body 10, and configured for selective access to the main body 10 by rotary motion.

The door 20 may be disposed on the front surface thereof with a dispenser 28 for supplying drinking water so that a user can access drinking water when the door 20 is closed. The door 20 may further include an excess water tray 282 for collecting excess dispensed water and disposed under the dispenser 28.

In addition, the door 20 may include an ice-making compartment 22 including an ice machine 100 for generating ice, a machine compartment 24 including a compressor 242 and a condenser 244, and an insulating member 26 disposed between the ice-making compartment 22 and the machine compartment 24 and configured to separate the ice-making compartment 22 and machine compartment 24 from each other.

Although an exemplary embodiment is described above, where the ice-making compartment 22 is disposed on the door 20 which is configured to open and close the refrigerating compartment R of the main body 10, embodiments include the case where the ice-making compartment is disposed on a door provided for selective access the freezing compartment F.

In addition, although an embodiment is explained as an example in which the ice-making compartment 22 is formed at an upper portion of the door 20 and the machine compartment 24 is formed at a lower portion of the door 20, the present invention is not limited thereto, and the present invention may be applied to the case where the ice-making compartment 22 is formed at a lower portion of the door 20 and the machine compartment 24 is formed at an upper portion of the door 20.

The insulating member 26 may include a foam component, e.g., urethane foam, therein, and may be configured to suppress heat exchange between the ice-making compartment 22 at a low temperature and the machine compartment 24 at a high temperature.

In addition, the door 20 may include a covering member which covers a surface facing the main body 10 so that the ice-making compartment 22 and the machine compartment 24 are not exposed to the exterior environment even when the door 20 is open. In addition, the covering member may function to insulate the internal compartment of the door 20 from the main body 10 when the door 20 is closed. To this end, the covering member may include a foam portion corresponding to the entire surface of the door 20. For convenience of description, FIG. 2 is illustrated with the covering member omitted.

In addition, the door 20 may be include an insulating material on the edges thereof in order to be insulated from the exterior environment.

The door 20 may include the compressor 242 and the condenser 244 on the inside of the machine compartment 24. In addition, an expansion valve (not shown) for performing a freezing cycle may also be disposed in the inside of the machine compartment 24, or may be disposed in the inside of the insulating member 26.

The compressor 242 may be a reduced size compressor which is smaller than a compressor generally provided to the main body of a refrigerator so that the compressor 242 can be installed within the limited compartment of the inside of the door 20. An example of a minimized compressor is disclosed in Korean Patent Laid-Open Publication No. 10-2013-0048817, which is herein incorporated by reference.

The condenser 244 may be coupled to the rear end of the compressor 242 through a refrigerant pipe 248. Through the compressor 242, compressed high-temperature high-pressure refrigerant may be converted into middle-temperature high-pressure liquid refrigerant. In addition, the condenser 244 may be a reduced size condenser configured to be disposed in the internal compartment of the door 20.

The compressor 242 and the condenser 244 may be connected to a power supply device (not shown) disposed in the main body 10 and configured to be supplied with electric power for performing cooling. In this case, cables which couple the compressor 242 and condenser 244 to the power supply device of the main body 10 may be provided in such a manner as to pass through a hinge pipe of the rotation shaft of the door 20.

A through-hole 246 may be formed on a surface of the door 20 which constitutes the machine compartment 24 so that when the door 20 is open, the machine compartment 24 can exchange heat with the exterior environment. When the door 20 is open, the condenser 244 can be cooled by external air introduced into the inside of the machine compartment 24 through the through-hole 246, and thus refrigerant in the condenser 244 can be condensed. To this end, the condenser 244 may be disposed on the surface thereof with a hole for introducing external air, and a structure for heat exchange between refrigerant and external air introduced through the hole may be formed inside the condenser 244.

The refrigerant pipe 248 couples the compressor 242 and the condenser 244, and extends from the rear end of the condenser 244 to the ice-making compartment 22 in an upper portion of the door 20 through the insulating member 26, and is coupled to the ice machine 100 in the ice-making compartment 22.

A detailed configuration of the ice machine 100 disposed in the ice-making compartment 22 is described with reference to FIGS. 3 to 6.

Figure 3:
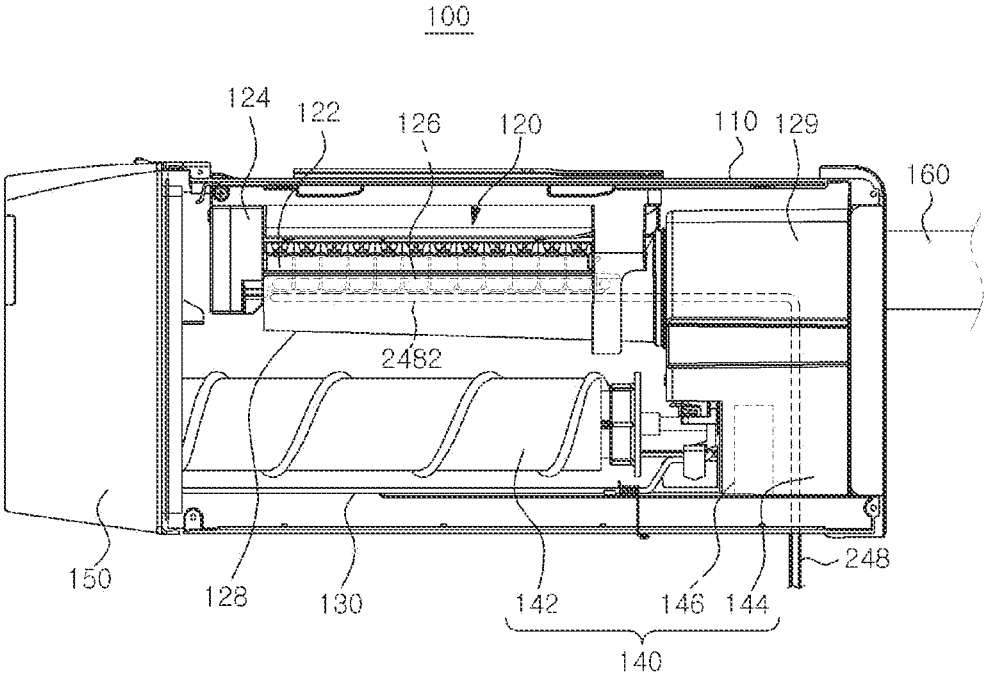
FIG. 3 is a front view illustrating an ice machine shown in FIG. 1.
Figure 4:
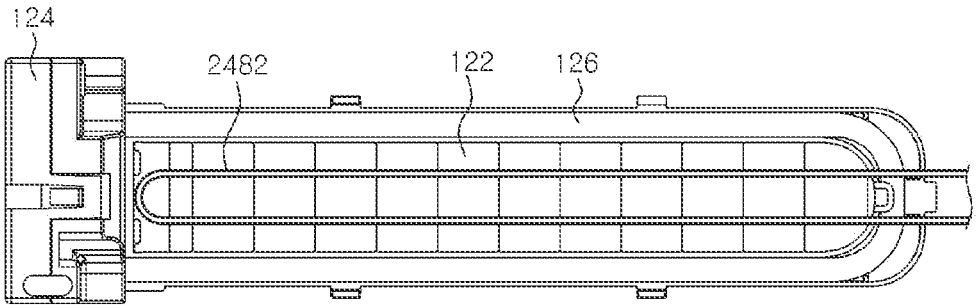
FIG. 4 is a perspective view illustrating a refrigerant pipe and an ice tray disposed inside the ice machine shown in FIG. 1.
Figure 5:
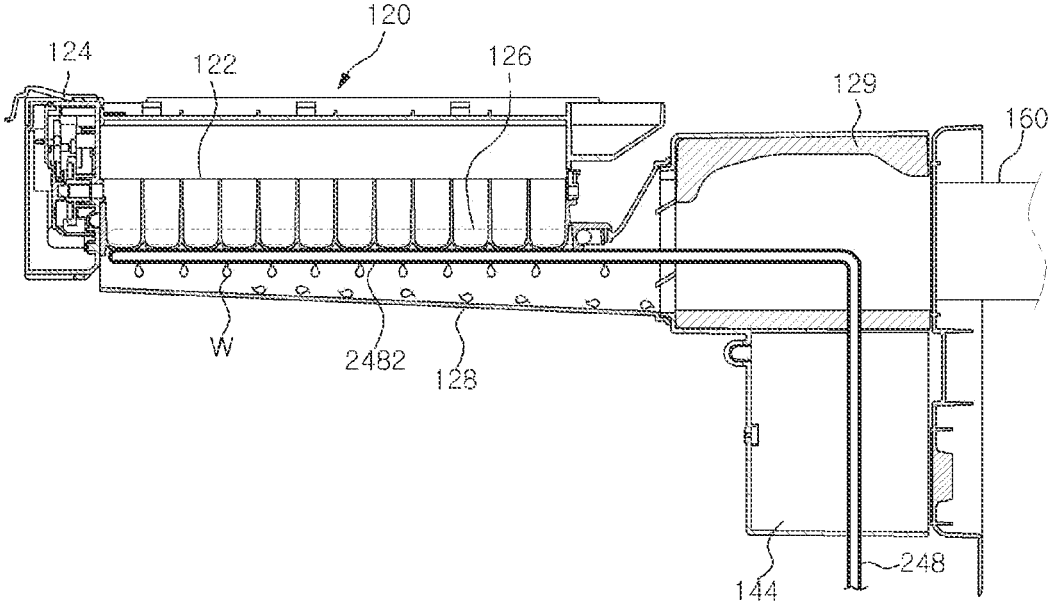
FIG. 5 is a cross-sectional view illustrating a portion of a structure which is disposed inside the ice machine shown in FIG. 1.
Figure 6:
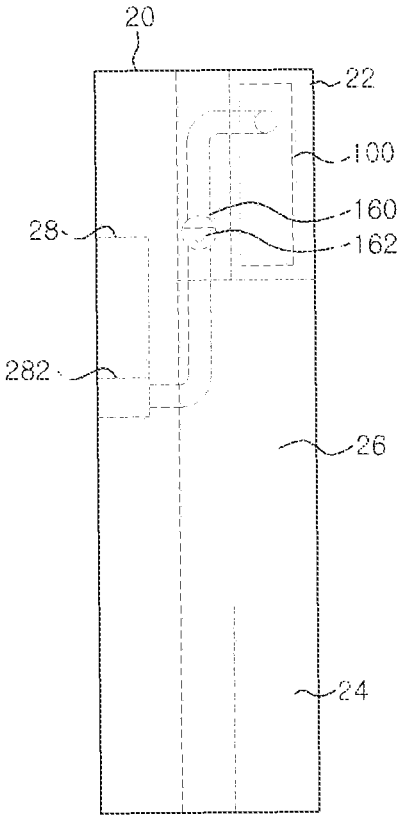
FIG. 6 is a side view of a door shown in FIG. 1.

FIG. 3 is a front view illustrating an ice machine shown in FIG. 1, FIG. 4 is a perspective view illustrating a refrigerant pipe and an ice tray disposed inside the ice machine shown in FIG. 1, FIG. 5 is a cross-sectional view illustrating a part of a structure disposed inside the ice machine shown in FIG. 1, and FIG. 6 is a side view of a door shown in FIG. 1.

Referring to FIGS. 3 to 6, the ice machine 100 may include a case 110, an ice-making assembly 120, an ice bucket 130, a transfer assembly 140, and an outlet part 150.

The case 110 may include therein a cooling compartment for generating ice, the ice-making assembly 120 may be disposed at an upper side in the cooling compartment, and the ice bucket 130 may be disposed under the ice-making assembly 120.

The ice-making assembly 120 may include an ice tray 122 which provides a frame for receiving and storing water and generating ice, a heater 126 provided along a peripheral portion of the ice tray 122, and a driving part 124 for rotating the ice tray 122 to drop ice from the ice tray 122. In addition, the driving part 124 drives the heater 126 to heat the surface of the ice tray 122 for a short period of time to slightly melt the surface of ice in contact with the surface of the ice tray 122 allowing the ice to be easily separated from the ice tray 122.

In addition, the ice-making assembly 120 includes a drain duct 128 for collecting defrost water W which is generated by removing frost with the heater 126.

The ice tray 122 provides a compartment for receiving water from a water supply pipe (not shown) or the like and for freezing the water to make ice, wherein the ice tray 122 may have a plurality of compartments formed to accommodate water on an upper surface thereof. The formed compartments may have various shapes according to the shapes of ice desired to be produced, and the number of the formed compartments may also vary.

The ice tray 122 may be made of a metal having a high heat conductivity, e.g., aluminum. As the ice tray 122 is made of a material with a relatively higher heat conductivity, the heat exchange rate between the ice tray 122 and refrigerant flowing along the refrigerant pipe is further improved.

The refrigerant pipe 248 extending from the machine compartment 24 may be in contact with a lower surface of the ice tray 122, wherein a portion of the refrigerant pipe 248 in contact with the ice tray 122 may be referred to as a contact portion 2482. The contact portion 2482 may be formed in a "U" shape as illustrated in FIG. 4. The contact portion 2482 may be formed in such a manner as to extend from one end of the ice tray 122, to be bent by 180° around the other end of the ice tray 122, to extend to the one end of the ice tray 122, and then coupled to the machine compartment 24.

However, this manner is merely an example, the contact portion 2482 may be formed in such a manner as to be bent multiple times so as to come into contact multiple times on the lower surface of the ice tray 122.

In this case, the contact portion 2482 may be configured in simple surface contact with the lower surface of the ice tray 122, or may be configured to be more strongly in contact with the lower surface of the ice tray 122 by an adhesive agent, a coupling member, or the like in order to increase the heat transfer efficiency.

Accordingly, refrigerant, which is subjected to compressing and condensing processes in the machine compartment 24 and then expanded and cooled by the expansion valve, is transferred to the contact portion 2482 of the refrigerant pipe 248. The transferred refrigerant freezes water held in the ice tray 122 via the contact portion 2482 and the ice tray 122. The water frozen as described above is phase-transformed to produce ice.

In other words, the contact portion 2482 of the refrigerant pipe 248 and the ice tray 122 function as an evaporator in a cooling cycle.

The existing refrigerator having an ice machine disposed on a door generates cold air through heat exchange between refrigerant and air, and then supplies the cold air to an ice tray via a cold air duct by a blower or the like, so that ice is generated by an indirect cooling scheme through heat exchange between gas and solid. In this case, since the heat exchange between gas and solid is poor in terms of heat exchange performance, it takes a long time to generate ice.

In contrast, according to an embodiment, since ice is generated by a direct cooling scheme through solid-solid heat exchange between the refrigerant pipe 248 and the ice tray 122, the heat exchange performance is excellent, and thereby the period of time required to generate ice can be remarkably reduced.

The ice made as described above is dropped to the ice bucket 130, which is disposed under the ice tray 122, by the driving part 124. The driving part 124 slightly melts the surface of ice in contact with the surface of the ice tray 122 by driving the heater 126 for a predetermined period of time. As the surface of ice is slightly melted, the ice in contact with the surface of the ice tray 122 can be released.

In this case, when a heating time by the heater 126 is excessively long, ice generated on the ice tray 122 may be completely melted. Therefore, for the heating, a period of time and an amount of generated heat may be set to slightly melt only the surface of ice. To this end, the ice-making assembly 120 may include a control unit (not shown) configured to control the function of the driving part 124.

When heating of the ice tray 122 stops, the upper surface of the ice tray 122 may be rotated to be oriented to the lower-side ice bucket 130 according to the rotation of a rotary shaft (not shown) of the driving part 124. The ice tray 122 may be twisted due to contract with a predetermined interference member (not shown) when the ice tray 122 is rotated over a specific angle, and, as a result of the twisting, pieces of ice in the ice tray 122 may be dropped to the inside of the ice bucket 130.

In addition, a plurality of ejectors (not shown) may be disposed in the length direction of the rotary shaft, and in one embodiment, ice may be discharged from the ice tray 122 only by rotation of the ejectors without rotation of the ice tray 122.

The heater 126 is disposed along a peripheral portion of the ice tray 122 and configured to heat the ice tray 122. In addition, the heater 126 includes a heating rod formed in a "U" shape. Both ends of the heating rod are coupled to the driving part 124, and the heating rod selectively generates heat according to the control mechanism of the driving part 124, thereby heating the ice tray 122.

The heater 126 configured as above may be used to heat the inside of the ice machine 100 in order to remove frost on the inside the ice machine 100 when ice making has been interrupted, in addition to the function of slightly melting the surface of ice in the ice tray 122 to easily separate the ice from the ice tray 122. A detailed configuration for such functionality will be described later.

When frost is removed by the heater 126, the frost is phase-transformed from solid to liquid, and thus defrost water W is generated. The drain duct 128 collects and discharges the generated defrost water W to the exterior. To this end, the drain duct 128 is disposed at a lower side of the ice tray 122, and one end of the drain duct 128 may be coupled to an outlet housing 129 which is disposed therein with a connection hole for coupling with the exterior environment.

In addition, the drain duct 128 is formed such that the lower surface thereof has a decline to be lower extends toward the outlet housing 129 so that collected defrost water W can flow to the outlet housing 129 and can be discharged to the exterior environment.

The connection hole is coupled to one end of a defrost water discharge pipe 160, and the other end of the defrost water discharge pipe 160 may be coupled to the excess water tray 282 of the dispenser 28. In addition, the defrost water discharge pipe 160 extends on the inside of the door 20 from the outlet housing 129, and is coupled to the excess water tray 282 of the dispenser 28, so that the defrost water discharge pipe 160 may be in a shape in which the door 20 is penetrated from the rear surface thereof to the front surface thereof.

In addition, in order to enable defrost water W to flow from the drain duct 128 to the excess water tray 282, the defrost water discharge pipe 160 additionally includes a transfer means 162. In this case, the transfer means 162 may be controlled by the control unit. The transfer means 162 may be, for example, a fan or a pump, and all means capable of enabling movement of the defrost water W, which is liquid, to flow without limitation thereof.

Accordingly, defrost water W collected in the drain duct 128 can flow to the outlet housing 129, and can be discharged to the excess water tray 282 of the dispenser 28 via the defrost water discharge pipe 160.

The transfer assembly 140 performs a function of transferring ice to the outlet part 150, and may include an auger 142, a motor housing 144, and an auger motor 146.

The auger 142 may be a rotary member which has a screw or wings having a spiral shape, and is configured to be rotated by the auger motor 146. The auger 142 may be disposed in the ice bucket 130. Pieces of ice stacked in the ice bucket 130 are inserted into gaps between the wings of the auger 142, and may be transferred to the outlet part 150 when the auger 142 is rotated. In addition, the auger motor 146 may be disposed in the motor housing 144.

The outlet part 150 may be coupled to a dispenser (not shown) disposed in the door 20, and ice transferred by the transfer assembly 140 according to user's selection may be provided to the user through the dispenser. In addition, although it is not shown, the outlet part 150 may be disposed with a cutting member capable of cutting ice into a predetermined size.

Hereinafter, the operation and effect of the refrigerator 1 having the aforementioned configuration according to an embodiment will be described.

In the refrigerator 1 according to an embodiment, refrigerant flowing through the refrigerant pipe 248 may be cooled through the compressor, the condenser, and the expansion valve, which are disposed on the door 20 for opening and closing the main body 10. The refrigerant cooled as described above is supplied to the contact portion 2482, where the refrigerant pipe 248 is in contact with the ice tray 122, and thus the ice tray 122 is directly cooled from the refrigerant.

The ice tray 122 may be supplied with water by a water supply means, which is not shown, the water supplied to the ice tray 122 can be cooled by the refrigerant supplied to the contact portion 2482, and thus the water can be phase-transformed to produce ice.

In one embodiment, the refrigerant may flow to the contact portion 2482 by compressive force supplied from the compressor 242.

The ice made in the ice tray 122, as described above, may be dropped downward by an operation of the driving part 124, and may be stacked in the ice bucket 130 disposed under the ice tray 122.

In addition, the refrigerant, which is transferred to the contact portion 2482 via the expansion valve and then is heat-exchanged with the ice tray 122, may again be transferred to the machine compartment 24 via the refrigerant pipe 248. The refrigerant transferred to the machine compartment 24 may be introduced into the compressor 242 to again start a freezing cycle.

The inside of the ice machine 100 is always maintained at below-zero temperatures in most cases in order to produce ice, outdoor air is introduced into the ice machine 100, and water vapor contained in the outdoor air may condense to generate frost. The frost generated attaches to the surfaces or insides of various mechanical devices in the ice machine 100, which may cause a malfunction or a fault.

In order to remove frost, a technique that transforms solid frost into liquid by driving the heater 126 and then discharges the liquid to the outside may be used. In this case, while the heater 126 generates heat in order to melt the surface of ice generated in the ice tray 122 on ice making, a portion of the frost may be removed. However, when a large amount of frost has been generated due to a long ice making period ice making, a brief heating period may be not enough to remove all the frost.

For this reason, the ice machine 100 may operate in two modes, e.g., an ice-making mode and a management mode, wherein the aforementioned ice-making procedure is performed in the ice-making mode. In the management mode, the driving part 124 drives the heater 126 to generate heat in a state in which a cooling cycle in the door 20 has been halted, so that frost covering the internal devices of the ice machine 100 including the ice tray 122 can be transformed into liquid by the heat generated from the heater 126 and be removed.

Defrost water W, into which frost is phase-transformed, may be collected in the drain duct 128. The defrost water W collected in the drain duct 128 may flow to the outlet housing 129 along the incline of the lower surface of the drain duct 128, and then may be discharged through the defrost water discharge pipe 160 to the excess water tray 282 of the dispenser 28 which is provided on the front surface of the door 20.

When the excess water tray 282 has been filled with defrost water W or dumped drinking water, a user may be signaled, notified, or informed to empty the excess water tray 282. To this end, a sensor (not shown) for sensing whether or not the excess water tray 282 is full of water, a display means (not shown) for displaying to the user that the excess water tray 282 is full of water, may be additionally included.

The ice machine 100 is usually driven to make ice in the ice-making mode, and the management mode may be repeated for preset periods. However, this configuration is merely an example. A method for controlling the management mode of the ice machine 100 can be freely modified and executed within a range without departing from the spirit of the invention.

In accordance with embodiments of the present invention, as described above, a piping structure of the refrigerator is simplified, the internal capacity of the refrigerator is maximized to increase the compartment utilization, the efficiency of energy used for cooling increases, high ice-making speed is achieved, and frost generated in the ice machine can be effectively removed.

While the invention has been shown and described with respect to the preferred embodiments, embodiments of the present invention are not limited thereto. It will be understood by those skilled in the art that various changes and modifications may be made without departing from the scope of the invention as defined in the following claims.

What is claimed is:

1. A refrigerator comprising an ice machine, the refrigerator comprising:

a main body comprising a storage compartment for food; a door disposed on the main body and comprising an ice-making compartment and for opening and closing the storage compartment;

a dispenser disposed on a front surface of the door, configured for dispensing drinking water, and comprising an excess water tray configured for collecting excess water from the dispenser;

a compressor, a condenser, and an expansion valve which are disposed on the door;

an ice tray disposed in the ice-making compartment, and configured to receive and accommodate water;

a refrigerant pipe configured to couple the compressor, the condenser, and the expansion valve, and to cool the ice tray by conduction;

a heater disposed at a peripheral portion of the ice tray;

a drain duct disposed under the ice tray, and configured to collect defrost water; an outlet housing coupled to the drain duct, the outlet housing having a connection hole disposed on the housing for communicating with an exterior environment; and a defrost water discharge pipe having one end connected to the connection hole of the outlet housing and the other end connected to the excess water tray, wherein defrost water collected in the drain duct is discharged to the excess water tray via the defrost water discharge pipe.

2. The refrigerator of claim 1, wherein the ice tray functions as an evaporator based on a cooling cycle for generating ice in the ice machine.

3. The refrigerator of claim 1, wherein at least a portion of the refrigerant pipe in contact with a lower surface of the ice tray.

4. The refrigerator of claim 1, wherein the defrost water discharge pipe comprises a transfer means for allowing flow of the defrost water.

5. The refrigerator of claim 1, wherein the door comprises a machine compartment, wherein the machine compartment and the ice-making compartment are partitioned from each other by an insulating member, and the compressor and the condenser are disposed in the machine compartment.

6. The refrigerator of claim 1, wherein a lower surface of the drain duct inclines downward toward the outlet housing.

7. The refrigerator of claim 1, wherein the defrost water discharge pipe extends on an inside of the door from the outlet housing and is connected to the excess water tray, the defrost water discharge pipe having a shape in which the defrost water discharge pipe penetrates the door from a rear surface of the door to a front surface of the door.

8. The refrigerator of claim 1, a sensor configured to sense a level of water in the excess water tray and to notify a user when the excess water tray is full.

9. An apparatus comprising:

a dispenser disposed on a door and configured for dispensing drinking water, and comprising an excess water tray configured for collecting excess water from the dispenser, wherein the door comprises an ice making compartment;

a compressor, a condenser, and an expansion valve which are disposed on the door;

an ice tray disposed in the ice-making compartment, and configured to receive and accommodate water;

a refrigerant pipe configured to couple the compressor, the condenser, and the expansion valve, and to cool the ice tray by conduction;

a heater disposed at a peripheral portion of the ice tray;

a drain duct disposed under the ice tray, and configured to collect defrost water;

an outlet housing coupled to the drain duct, the outlet housing having a connection hole disposed on the housing for communicating with an exterior environment; and a defrost water discharge pipe having one end connected to the connection hole of the outlet housing and the other end connected to the excess water tray, wherein defrost water collected in the drain duct is discharged to the excess water tray via the defrost water discharge pipe.

10. The apparatus of claim 9, wherein the ice tray functions as an evaporator based on a cooling cycle for generating ice.

11. The apparatus of claim 9, wherein at least a portion of the refrigerant pipe in contact with a lower surface of the ice tray.

12. The apparatus of claim 9, wherein the defrost water discharge pipe comprises a transfer means for allowing flow of the defrost water.

13. The apparatus of claim 9, wherein the door comprises a machine compartment, wherein the machine compartment and the ice-making compartment are partitioned from each other by an insulating member, and the compressor and the condenser are disposed in the machine compartment.

* * * * *